US006394564B1

(12) United States Patent
Mrotz, III. et al.

(10) Patent No.: US 6,394,564 B1
(45) Date of Patent: May 28, 2002

(54) OVERHEAD STORAGE UNIT

(75) Inventors: Walter C. Mrotz, III.; David P. Noel, both of County of Muskegon; Thomas A. Langworthy, County of Kent, all of MI (US)

(73) Assignee: Knoll, Inc., East Greenville, PA (US)

( * ) Notice: Subject to any disclaimer, the term of this patent is extended or adjusted under 35 U.S.C. 154(b) by 536 days.

(21) Appl. No.: 08/868,081

(22) Filed: Jun. 3, 1997

(51) Int. Cl.[7] ..... A47G 29/00

(52) U.S. Cl. ..... 312/265.5; 312/263; 312/247; 312/323

(58) Field of Search ..... 312/257.1, 263, 312/265.5, 245, 247, 265.6, 139.1, 323; 108/108

(56) References Cited

U.S. PATENT DOCUMENTS

| | | | | | |
|---|---|---|---|---|---|
| 2,571,622 | A | * | 10/1951 | Schmidt | 312/263 |
| 2,732,273 | A | * | 1/1956 | Schaffner | |
| 2,899,254 | A | * | 8/1959 | Latzko | 312/265.5 |
| 3,496,889 | A | * | 2/1970 | Protzmann et al. | |
| 3,729,113 | A | * | 4/1973 | Lopatka | 312/247 X |
| RE28,994 | E | | 10/1976 | Aylworth | |
| 4,171,150 | A | * | 10/1979 | Soderlund | 312/265.5 |
| 4,265,500 | A | * | 5/1981 | Berton et al. | 312/263 X |
| 4,288,132 | A | * | 9/1981 | Znamirowski et al. | 312/265.5 |
| 4,295,693 | A | * | 10/1981 | Viklund | 312/265.5 |
| 4,591,214 | A | * | 5/1986 | Reuter et al. | |
| 4,618,192 | A | | 10/1986 | Kelley | |
| 4,955,672 | A | * | 9/1990 | Pham | 312/247 X |
| 5,022,541 | A | * | 6/1991 | White | 108/108 X |
| 5,094,174 | A | | 3/1992 | Grund et al. | |
| 5,172,969 | A | | 12/1992 | Reuter | |
| D339,934 | S | | 10/1993 | Reuter | |
| 5,409,308 | A | | 4/1995 | Reuter | |
| 5,538,213 | A | * | 7/1996 | Brown | 108/108 X |

FOREIGN PATENT DOCUMENTS

| | | | | |
|---|---|---|---|---|
| FR | 2365314 | * | 5/1978 | 312/265.5 |
| FR | 2387003 | * | 12/1978 | 312/265.5 |

OTHER PUBLICATIONS

"Tango Vertical Storage Unit VSU and VSU Mount Screen" Installation Instructions, Haworth, Inc. (4 pages).

* cited by examiner

*Primary Examiner*—Peter M. Cuomo
*Assistant Examiner*—Hanh V. Tran
(74) *Attorney, Agent, or Firm*—Buchanan Ingersoll, P.C.

(57) ABSTRACT

An overhead storage unit for a modular open office system is provided. The storage unit can be either a freestanding unit or a panel mounted unit. The present invention provides easy to assemble units utilizing a minimum of different components for inexpensive manufacturing and ease of construction. In the freestanding unit, identical end panels are used; whereas in the panel mounted unit complementary right and left end panels are formed. In either unit, the shelves and doors are of identical shape. When assembled, engagement tabs on the panel mounted unit prevent the storage unit from being inadvertently removed.

4 Claims, 7 Drawing Sheets

OVERHEAD STORAGE UNIT

BACKGROUND OF THE INVENTION

1. Field of the Invention

The present invention relates to modular office systems, and more particularly to an overhead storage unit for use with such office systems.

2. Description of the Prior Art

Modular office systems in which individual panel assemblies are used to configure large work areas are well known in the art. More recently, improvements have been made in both the look and functionality of the panel assemblies. Due to constantly changing work environments, it is desirable to have office systems which allow for ease of redesign and flexibility in the mounting of accessories, for example, to the panel assemblies.

In the case of an overhead storage unit, it is often necessary to provide a preconstructed unit which is then secured to a panel such as by bolting or screwing the storage unit to the panel frame. This often necessitates manufacture and/or construction of the storage unit at the factory and shipping the unit in an assembled condition. This can be inconvenient in that the bulk of the assembled unit is much more difficult and costly to ship than is a unit which can be shipped as piece units which are then manufactured in the field at the individual work area location. Moreover, for units which are shipped as individual components which are then assembled in the field, it is desirable to have a storage unit or other accessory which is easy to construct, not requiring detailed instructions.

Units mounted on the panel assemblies must also be securable to the panels such that they are not capable of inadvertently falling from the panel, such as would occur if the person accidentally bumped the unit. What is needed, therefore, is an overhead storage unit which can be attached to a panel for an open office system workstation, which can be shipped as individual components which can be then manufactured in the field. The unit must be lightweight for shipping, and have components which are easy to manufacture and thus inexpensive to build.

It is therefore an object of the present invention to provide an overhead storage unit for a modular office system wherein the storage unit is made up of easily assembled individual components.

It is another object of the present invention to provide a mountable overhead storage unit which is made of components which are as easy to assemble as are the individual panel assemblies which make up the modular office system.

It is a further object of the present invention to provide a modular overhead storage unit having a minimum of different individual parts which are capable of simple construction without detailed instructions or tooling.

It is a still further object of the present invention to provide an overhead storage unit which is easily mounted on a panel assembly which prevents inadvertent falling of the unit from the panel.

SUMMARY OF THE INVENTION

The above objects are attained by the present invention, according to which, briefly stated, a modular overhead storage unit is provided for an office system which is made up of a pair of end panels and one or more shelves. In one embodiment of the invention, the end panels are identical pieces, as are each of the shelves. In a second embodiment of the invention, each of the end panels have angled engagement tabs on a back edge thereof for engaging support frames of a panel assembly, in which the engagement tabs prevent inadvertent removal of the storage unit from the panel. A door is provided for the storage unit, which door presents a curved surface which matches the edges of the end panels so as to present a clean, visually pleasing appearance. The individual components of the overhead storage unit can be mass produced such as by stamping or roll forming the metal parts which can be easily assembled on site, without requiring special tooling or detailed instructions to assemble the unit and/or mount it on the panel assembly.

A method of manufacturing a storage unit comprises the steps of providing a first piece of sheet metal and forming a first end panel from the first piece of sheet metal, the first end panel having a first outer side, a first inner side, a first bottom edge and a first top edge, wherein the first bottom edge is formed to provide a first shelf attachment area on the first inner side. A second end panel is formed from a second piece of sheet metal, the second end panel having a second outer side, a second inner side, a second bottom edge and a second top edge, wherein the second bottom edge is formed to provide a second shelf attachment area on the second inner side. A third piece of sheet metal is formed into a shelf having a top surface, a bottom surface, a left end and a right end, wherein each of said left and right ends are formed to provide a left end panel attachment area and a right end panel attachment area on the bottom surface. The left end panel attachment area is secured to the first shelf attachment area, and the right end panel attachment area is secured to the second shelf attachment area, whereby the storage unit is assembled.

BRIEF DESCRIPTION OF THE DRAWINGS

Various other objects, features, and advantages of the invention will become more apparent by reading the following detailed description in conjunction with the drawings, which are shown by way of example only, wherein.

DETAILED DESCRIPTION OF THE PREFERRED EMBODIMENTS

Figure 1:
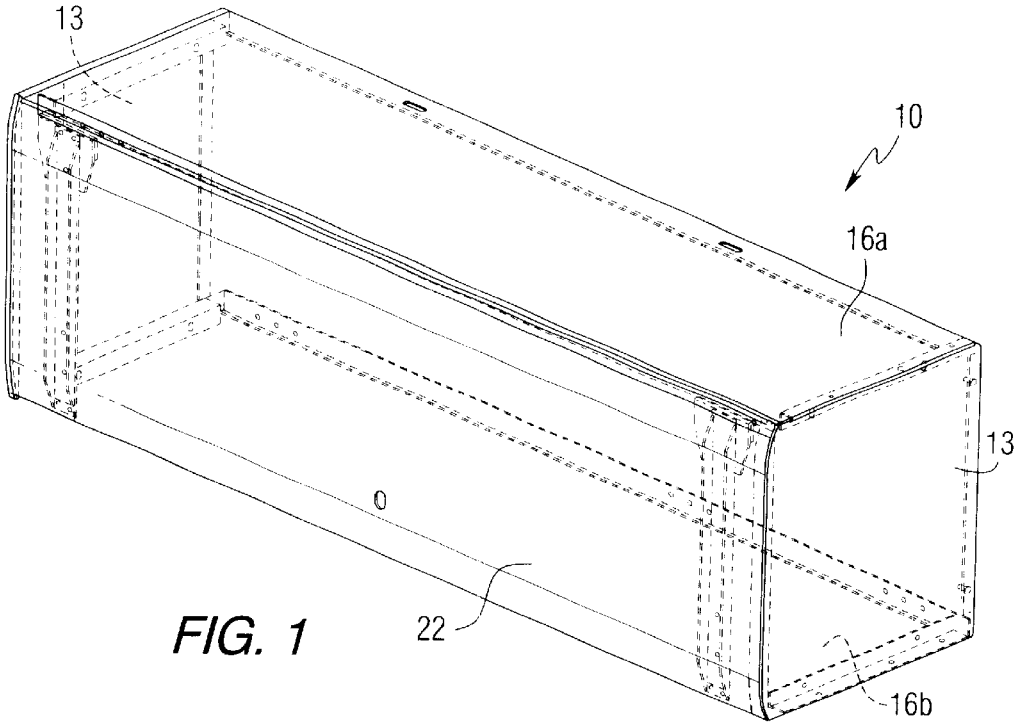
FIG. 1 is an isometric view of a storage unit according to one embodiment of the present invention.
Figure 2:
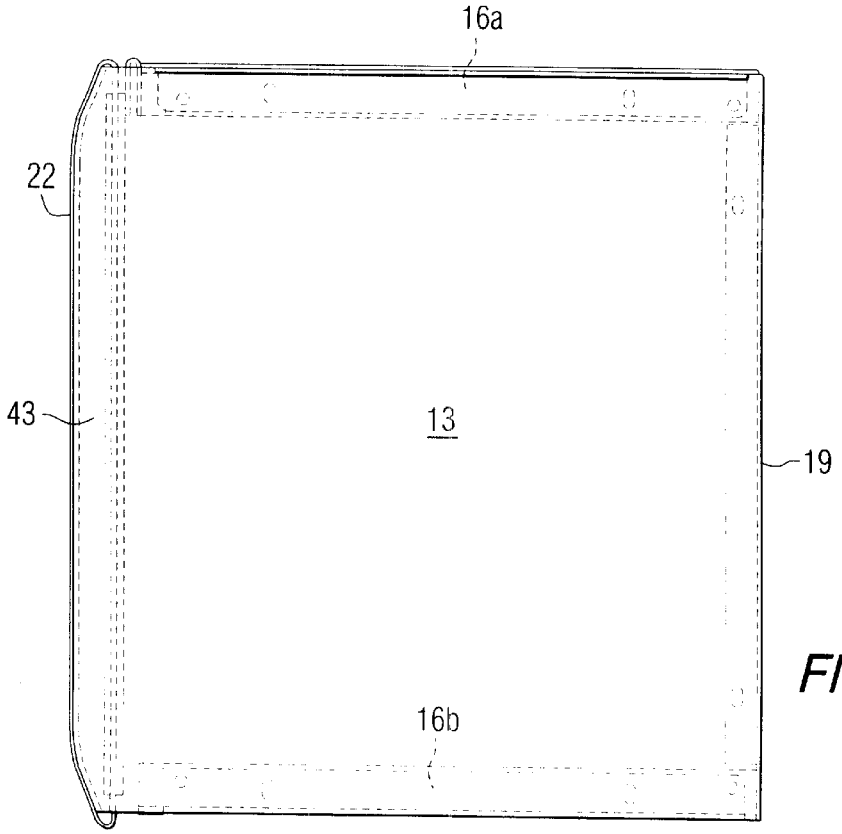
FIG. 2 is a side view of the storage unit shown in FIG. 1.
Figure 3:
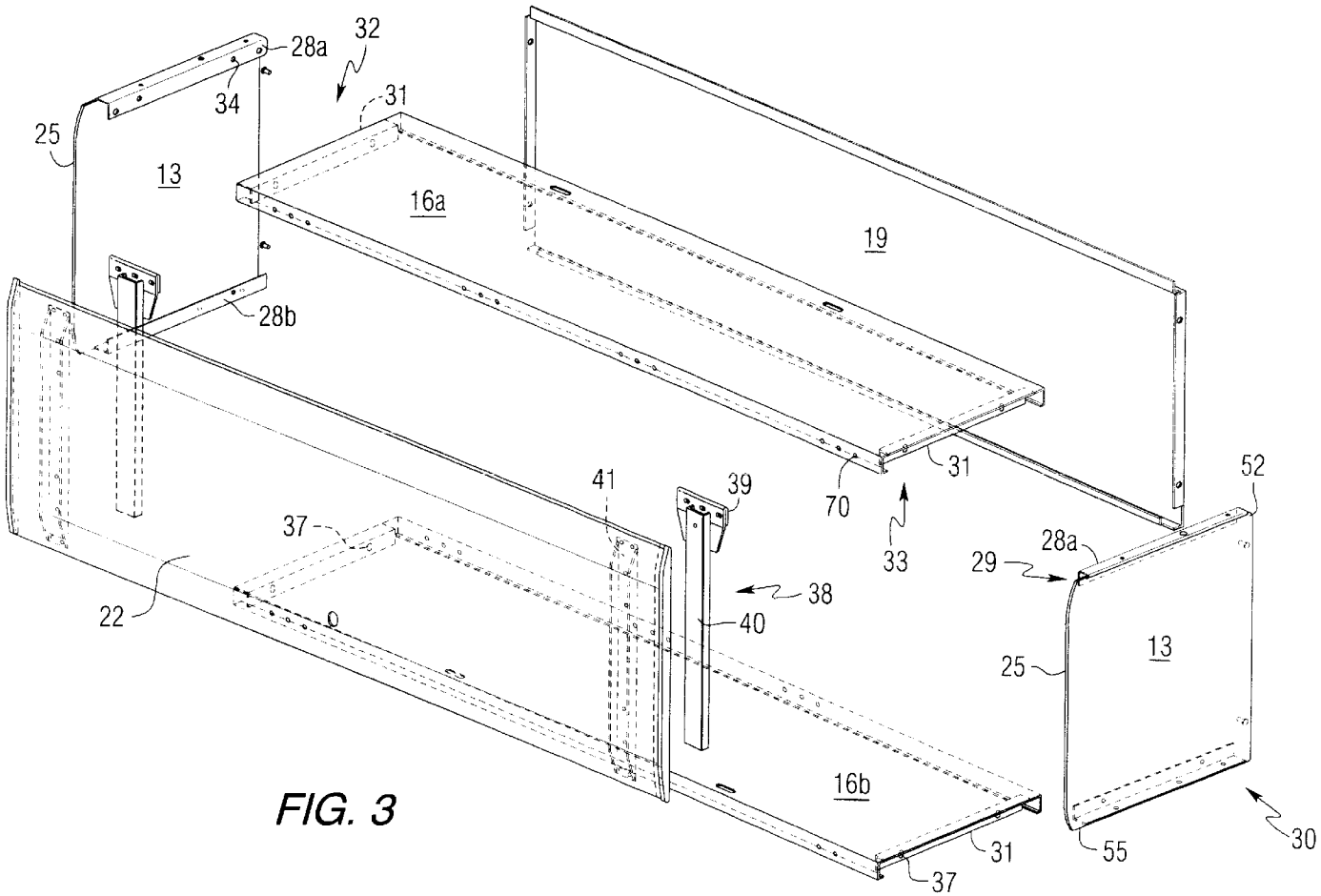
FIG. 3 is an exploded view of a storage unit shown in FIG. 1, showing details of the individual components of the unit.

Referring now to the drawings in detail, FIGS. 1–3 show one embodiment of an overhead storage unit 10 according to the present invention. The storage unit is comprised of a pair of end panels 13, and one or more shelves 16 (shown in the figures as comprising a top 16*a* and bottom 16*b* shelf). In the freestanding unit 10 as shown, there is also included a back panel 19. The unit may also include a door 22 operably connected to the top shelf 16*a* such that when in the closed position (FIGS. 1 and 2) the door is adjacent the front edges 25 of the end panels 13 and when in the open position is adjacent the top shelf 16*a*.

Each of the end panels includes a shelf attachment area 28 which is formed preferably at both the top 29 and bottom 30 portions of the end panel 13. In the embodiment shown in FIG. 3, it can-be seen that the end panels are made of identical construction such that an end panel can be either a left or right end panel for the unit. In this way, only a single end panel needs to be manufactured, preferably by progressive die stamping.

Also as shown in FIG. 3, each of the shelves comprises an identically formed unit, which is also preferably formed such as by roll forming a piece of sheet metal. On either end of a bottom surface of the shelves 16 is an end panel attachment member 31. As shown in the figure, the left end panel attachment member 32 of top shelf 16*a* is secured to the top shelf attachment area 28*a* on the left end panel, whereas the right end panel attachment member 33 of the top shelf 16*a* is secured to the top shelf attachment area 28*a* on the right end panel.

Both the shelf attachment areas on the end panels, as well as the bottom surfaces of the shelves, are of identical construction such that a shelf can be attached as either a top 16*a* or bottom 16*b* shelf. In this way, one shelf 16 needs to be manufactured for the storage unit, giving rise to ease of manufacturability in that only one shelf form need be stamped out or roll formed from the sheet metal. Preferably, the shelves are secured to the end panels by screws passing through complementary holes 34, 37 in each of the shelf attachment areas 28 and the end panel attachment members 31, respectively.

Figure 4:
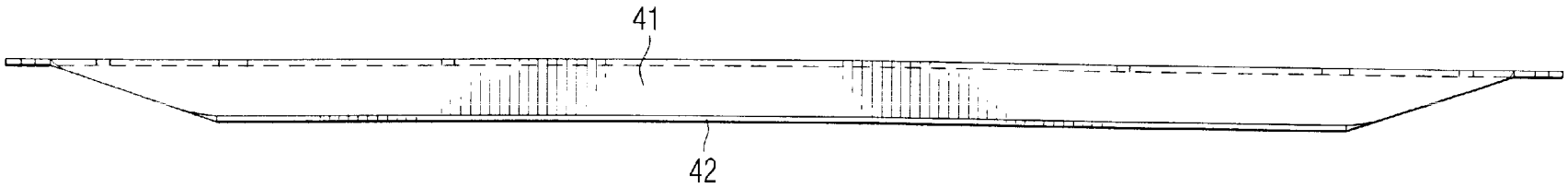
FIG. 4 is a perspective view of a hat channel bracket for a slidable door according to one embodiment of the present invention.

In units where two shelves are provided to form the top and bottom of the cabinet, the door 22 is preferably provided for the front of the cabinet 10. The door 22 is connected to the top shelf 16*a* by glide hinges 38. Each of the glide hinges 38 comprises a hinge member 39 and a glide assembly 40. In this manner, the top of the door is pivotally connected to the top shelf by means of the hinge member 39 such that when the door is swung open it can then be slid back so as to be adjacent to the top shelf 16*a*. When in the closed position, the outer surface of the door 22 comprises a curved surface which is complementary to the curvature of the front edge 25 of each of the end panels such that the unit as a whole presents a clean, visually pleasing appearance. The glide assembly portion 40 of the glide hinge is connected to the door 22 by means of a hat channel bracket 41 (shown in FIG. 4). The shape of the hat channel bracket 41 as shown in FIG. 4 is such that the channel portion 42 is shaped to abut against the inner surface of the door. The glide hinge 40 is then secured to the hat channel bracket 41 so as to be generally flush with the door 22. As shown in the side view of FIG. 2, a decorative insert 43 is provided in the roll formed door member. This trim piece, preferably made of plastic, is easily pressed into the sides of the door 22, so as to provide a finished appearance for the assembled unit.

The embodiment shown in FIGS. 1–3 is commonly referred to as a freestanding unit. This unit can also be mounted, such as by threading a screw or bolt through holes 44 in bottom portion 30 of the end panel 13 and secured to vertical stanchions or upmount brackets (not shown). When used as a freestanding unit on a desk, the back panel 19 is preferably secured to the end panels 13 by weld pins or weld screws 46 and provides a closed surface for the storage cabinet.

Figure 5A:
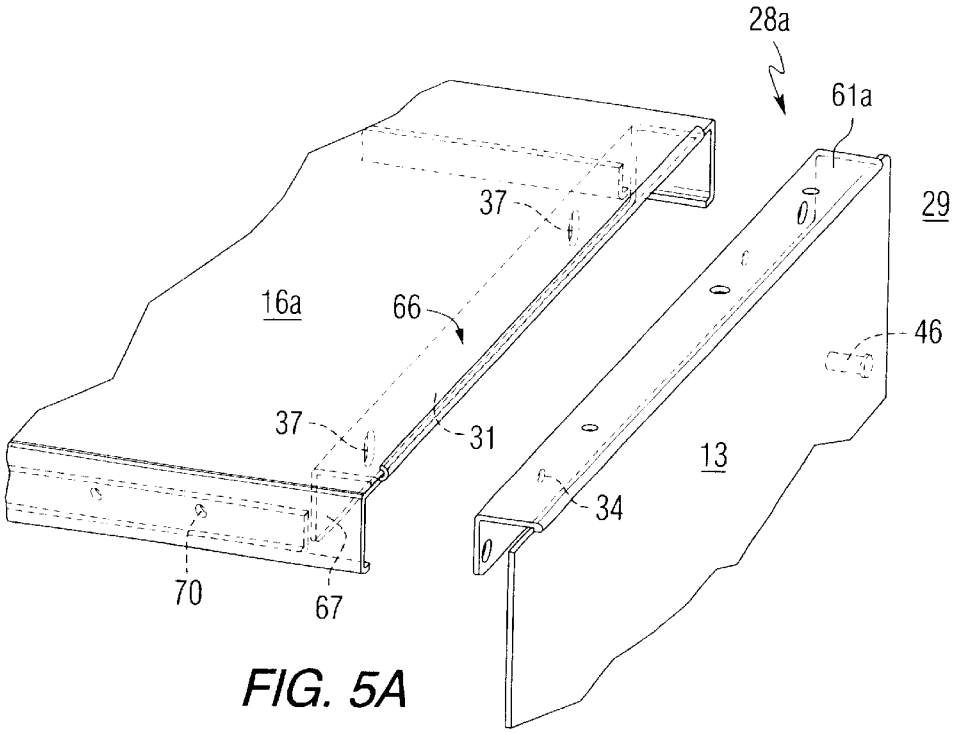
FIG. 5, consisting of FIGS. 5A and 5B, are detailed views showing the attachment of a top and bottom shelf to an end panel.
Figure 5B:
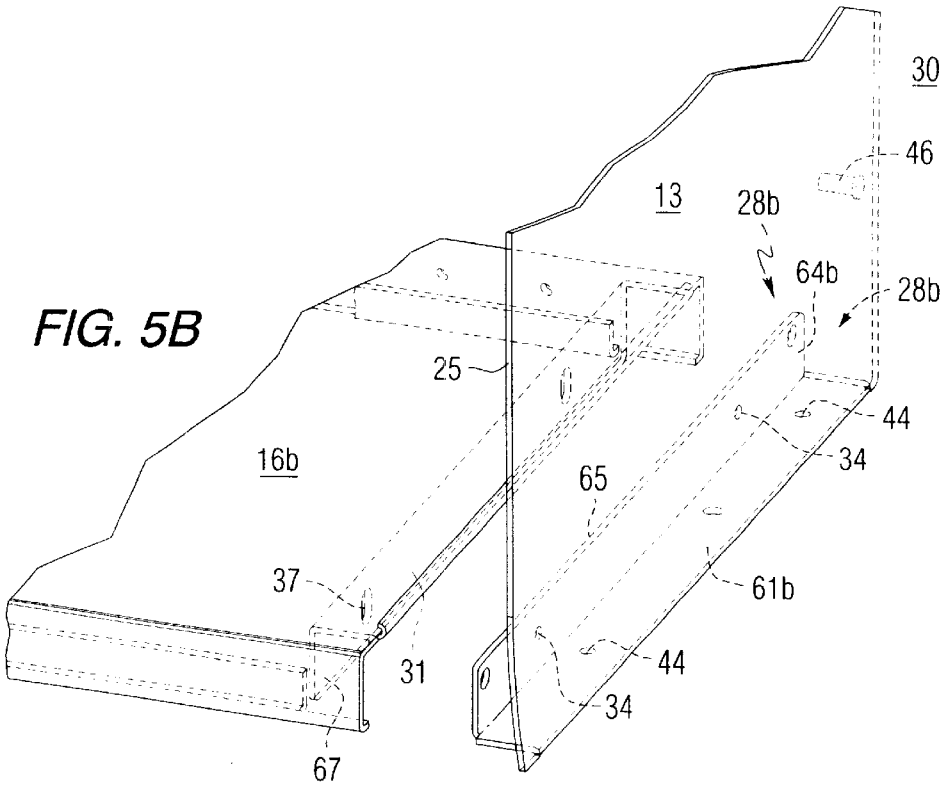
Figure 6A:
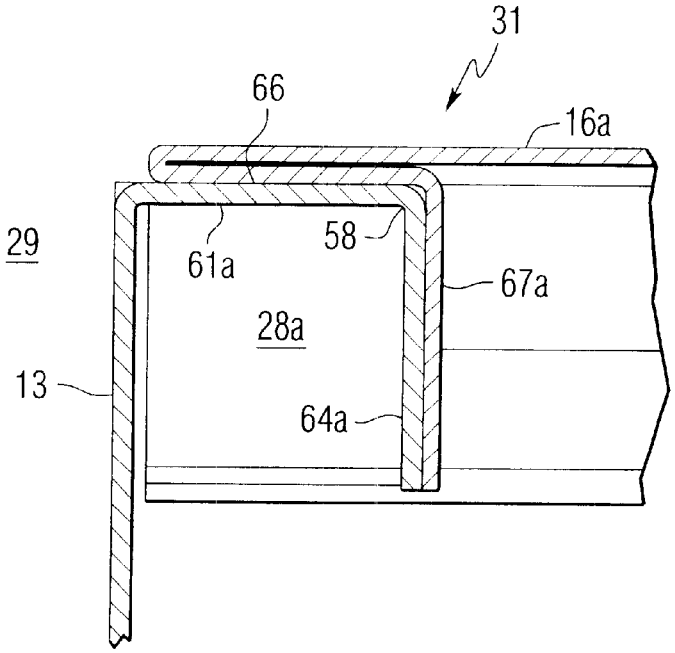
FIG. 6, consisting of FIGS. 6A and 6B, are detailed views showing the attachment of a top and bottom shelf to an end panel.
Figure 6B:
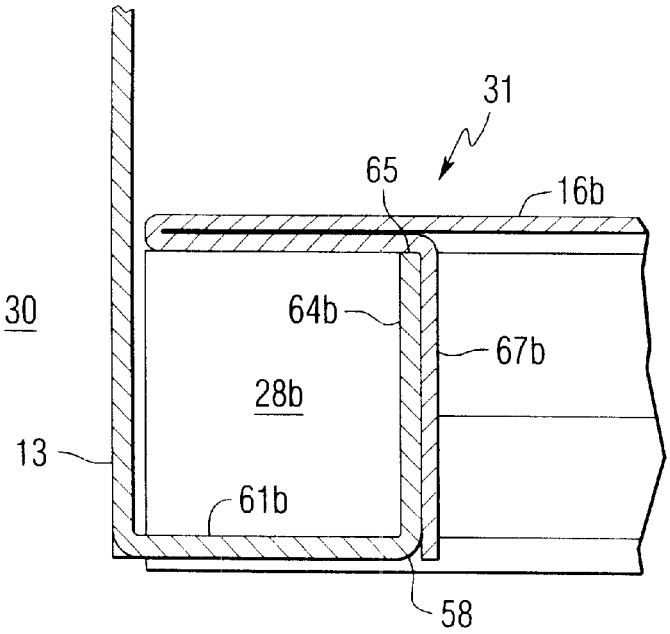

Referring to FIGS. 5 and 6, it can be seen that the shelf attachment areas 28 formed on the end panels 13 are of a complementary shape such that with the freestanding unit 10 the end panels are substantially identical. Both the top 29 and bottom 30 portions edge of the end panels are formed with the shelf attachment areas therein, the shelf attachment areas each comprising a right angled member 58. The shelf attachment area is on the inner side of the end panel 13 such that on the top portion 29 a horizontal portion 61*a* of the right angle member projects inward and the vertical member 64*a* projects downward therefrom. Similarly, on the bottom portion 30 the horizontal member 61*b* projects inward and the vertical member 64*b* projects upward therefrom. The bottom shelf 16*b* is attachable to the bottom, or first and second, shelf attachment areas 28*b* by resting the end panel attachment members 31 on the edges 65 of the vertical members 64*b* on the bottom portions 30 of each of the end panels 13. The top shelf 16*a* is secured to the top, or third and fourth, shelf attachment areas 28*a* by the complementary formed horizontal shelf portion 66 on the bottom surface of the top shelf which is supported on the horizontal portion 61*a*. A vertical member 67 of the shelf abuts against the vertical members 64 of the end panel. The shelves are then held in place by screws passing through holes 34 and 37.

In this manner, identical shelves having substantially similar cross sections can be formed and can be attached as either a top or bottom shelf. In order to attach the hinge member 39 of the glide hinges 38 to the top shelf 16*a*, holes 70 may be provided on one edge of the shelves 16 to accommodate the mounting screws for the glide hinges. The glide hinges allow the top of the door to pivot on the top shelf, and then slide back over the top shelf by means of the glide assembly 40 in a manner well known in the art.

Figure 8:
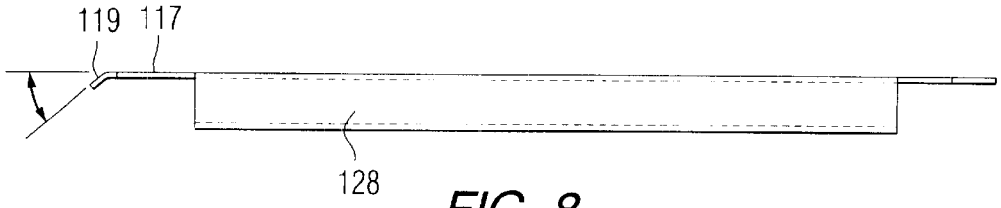
FIG. 8 is a top view of the end panel shown in FIG. 7.
Figure 7:
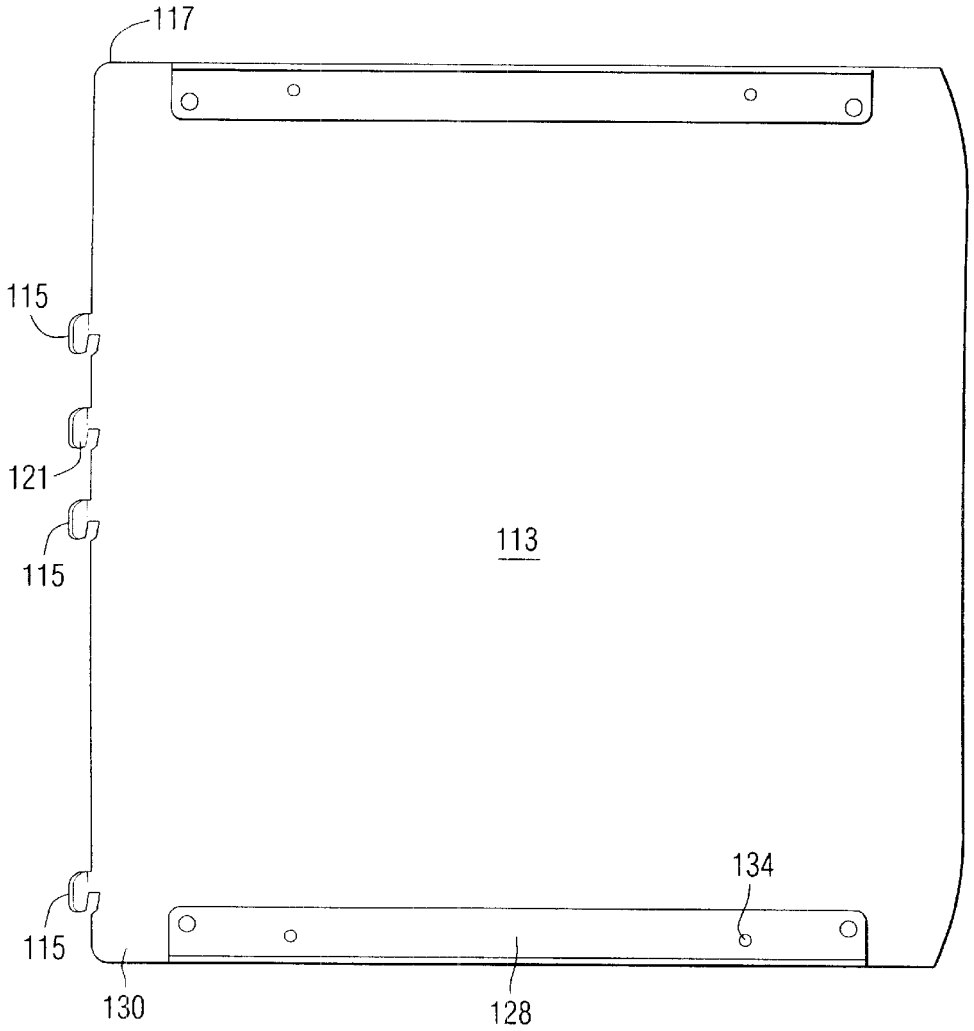
FIG. 7 is a side view of a storage unit end panel according to a second embodiment of the present invention.

Referring now to FIGS. 7 and 8, end panels 113 for a second embodiment of the present invention will be described in detail. In this embodiment, engagement tabs 115 are provided on the back edge 117 of each of the end panels. These engagement tabs engage slots in a pair of supports for the panel assemblies as will be described in detail below. As shown in particular in FIG. 8, the engagement tabs have an angled portion which is angled inward with respect to the inner surface of the end panel 113. Preferably, the angled portions 119 are angled inward from about 33 to 46 degrees, and most preferably at about 40 to 46 degrees. That is, the angled portions project inward towards the storage unit when in the assembled condition. A downwardly projecting hook portion 121 engages slots 123 in each of the vertical support members 125 (only one of which is shown in the Figure). In this embodiment, separate right and left end panels are provided for the assembled storage unit.

Figure 9:
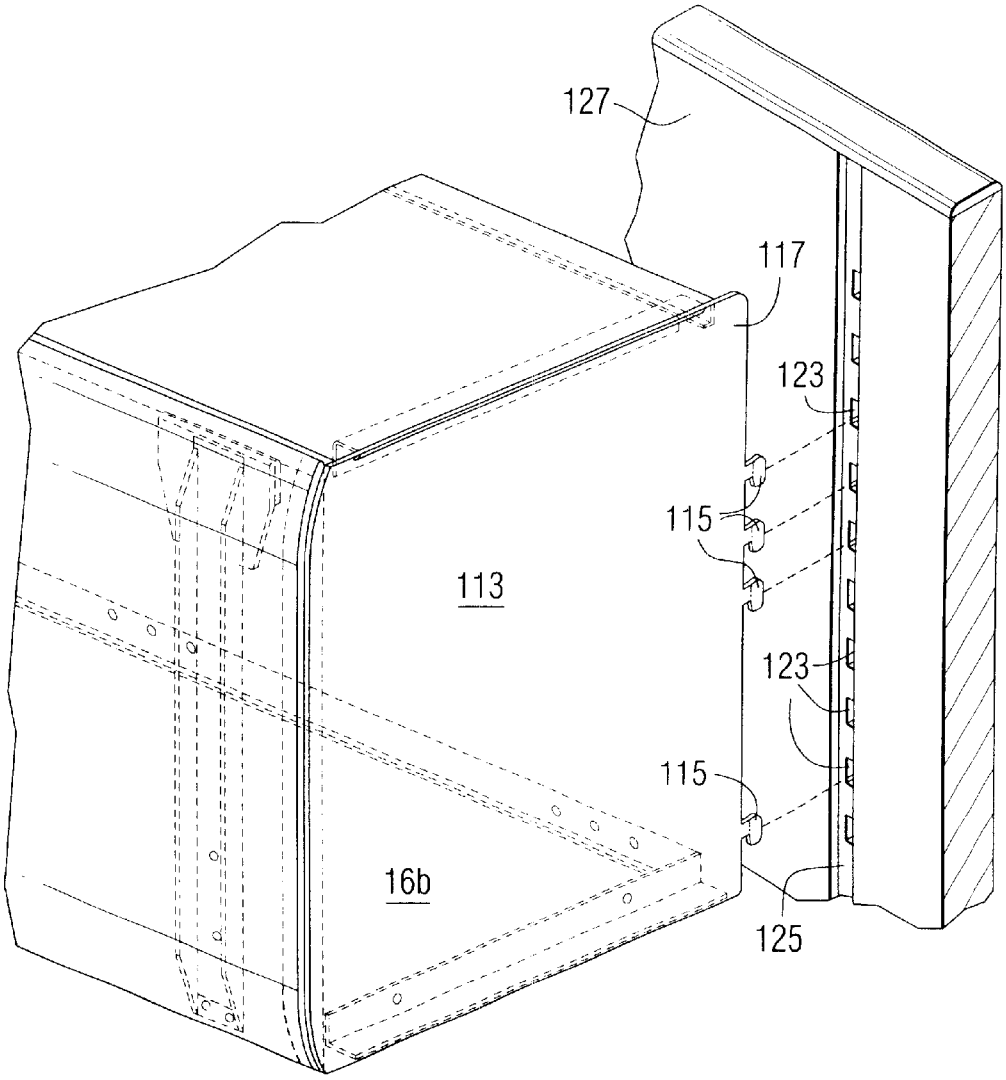
FIG. 9 is a perspective view of a portion of a panel assembly having a slotted vertical support member for the overhead storage cabinet of the present invention thereon.

In order to manufacture this panel mounted storage unit so as to be mounted such as in an overhead manner above a work desk, each of the end panels 113 are first attached to the support frame for the panel. As shown in FIG. 9 this is done by inserting the engagement tabs into slots 123 of each of the vertical support members 125 provided in the panel frame support, such that the hook portion is secured to the panel frame. The use of engagement tabs on supporting accessories for modular office components is well known, however, the engagement tabs of the present invention provide a unique advantage. After the end panels have been attached to the supports 125 for the panel assembly 127, a bottom shelf can be secured to the shelf attachment area 128 on the bottom portion 130 of the end panels in a similar manner to that of the first embodiment previously discussed. If desired, only one shelf can be provided for the unit so as to provide an open shelf storage area, and the right and left end panels would not include the top shelf attachment area and door. In either case, with either one or two shelves, after the bottom shelf is secured to each of the end panels by inserting screws through the holes in the shelves which then are threadingly engaged with holes 134 in the end panel 113, the storage unit cannot be removed from the panel support frame. This is due to the fact that the angled portions of the end panel are both angled inward with respect to the storage unit. Thus, with the shelf in place, it is relatively difficult, if not impossible, to remove the end panels from the slots in that they cannot be angled with respect to the panel support frame so as to remove the engagement tabs from the vertical slots. With the panel mounted unit, a back panel is not included since the back edges of the end panels abut against the panel frame assembly.

The storage unit of the present invention can be utilized with the Panel Frame Assembly which is the subject of U.S. patent application Ser. No. 08/868,083 filed on Jun. 3, 1997, which application is assigned to the present assignee and incorporated herein by reference.

In this manner, the modular overhead storage unit of the present invention provides an easy to ship unit which can be shipped in an unassembled condition and can be easily constructed in the field at the work station location. In the case of the first embodiment, identical shelves and end panels are provided so as to provide ease of manufacturability. In the second embodiment (FIGS. 7 and 8), although two separate end panels are provided, the end panels are of a complementary or mirror image shape. In either embodiment, both the shelves and the door for the storage unit can be identical. Thus, the storage unit of the present invention provides an inexpensive to manufacture and ship storage unit which can be easily assembled into a modular office system.

While specific embodiments of the invention have been described in detail, it would be appreciated by those skilled in the art that various modifications and alterations would be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A wall member for a modular office system, the wall member comprising:

a panel assembly including a pair of spaced apart vertical support members having a plurality of slots therein, and a storage unit operatively connected to the panel assembly, the storage unit further comprised of:

a first end panel having a first outer side, a first inner side, a first bottom edge and a first top edge, a first front edge and a first back edge, wherein the first bottom edge includes a first shelf attachment area on the first inner side and the first back edge includes first engagement tabs having a first angled portion which projects inward towards the first inner side thereon;

a second end panel having a second outer side, a second inner side, a second bottom edge and a second top edge, a second front edge and a second back edge, wherein the second bottom edge includes a second shelf attachment area on the second inner side and the second back edge includes second engagement tabs having a second angled portion which projects inward towards the second inner side;

a first shelf having a first top surface, a first bottom surface, a first left end and a first right end, wherein the first left end is secured to the first shelf attachment area and the first right end is secured to the second shelf attachment area; and wherein said first engagement tabs engage slots in one of said pair of vertical supports and said second engagement tabs engage slots in another of said pair of vertical supports such that the storage unit is not inadvertently removable from the panel assembly.

2. The wall member as recited in claim 1, wherein the first top edge includes a third shelf attachment area on the first inner side and the second top edge includes a fourth shelf attachment area, the storage unit further comprising a second shelf having a second top surface, a second bottom surface, a second left end and a second right end, wherein the second left end is securable to the third shelf attachment area and the second right end is securable to the fourth shelf attachment area.

3. The wall member as recited in claim 2, wherein said first shelf is attached to said end panels on a lower portion thereof, and said second shelf is attached to said end panels at an upper portion thereof, whereby said first shelf is a bottom shelf and said second shelf is a top shelf.

4. The wall member as recited in claim 3, further comprising a door pivotally connected to the top shelf, the door having a closed position wherein the door is adjacent to said front edges of said end panels and an open position wherein the door is adjacent the top surface of the top shelf.

* * * * *